United States Patent [19]

Smith et al.

[11] 4,032,782

[45] June 28, 1977

[54] TEMPERATURE STABLE MULTIPOLE MASS FILTER AND METHOD THEREFOR

[75] Inventors: Ronald D. Smith, Bovingdon, England; William J. Fies, Portola Valley, Calif.; John R. Reeher, Los Gatos, Calif.; Michael S. Story, Los Gatos, Calif.

[73] Assignee: Finnigan Corporation, Sunnyvale, Calif.

[22] Filed: June 4, 1976

[21] Appl. No.: 692,846

[52] U.S. Cl. ..... 250/292; 250/290

[51] Int. Cl.² ..... H01J 39/34

[58] Field of Search ..... 250/292, 290, 281, 282, 250/283

[56] References Cited

UNITED STATES PATENTS 3,553,451 1/1971 Uthe ..... 250/292

*Primary Examiner*—Craig E. Church

*Attorney, Agent, or Firm*—Flehr, Hohbach, Test, Albritton & Herbert

[57] ABSTRACT

A method of selecting a material for the construction of a multipole mass filter that is temperature stable or in other words, the $R_o$ parameter remains invariant with change in temperature. The coefficients of thermal expansion of the quadrupole rods and mounting structure are chosen so that a constant ratio of the two is provided which in turn is determined by the geometrical construction of the filter.

5 Claims, 5 Drawing Figures

TEMPERATURE STABLE MULTIPOLE MASS FILTER AND METHOD THEREFOR

BACKGROUND OF THE INVENTION

The present invention is directed to a temperature stable multipole mass filter and method therefor and more specifically to a method for maintaining the $R_o$ parameter of a quadrupole mass spectrometer constant over a wide temperature range; in other words, to provide a mass to charge ratio (M/e) which does change with temperature so that if a single mass setting voltage is used rather than a scan the mass spectrometer will function effectively.

With the advent of mass spectrometers of the quadrupole type which are used for selecting a single mass peak (as opposed to the use of a mass scan) it is necessary to have accuracies as much as one part in 100,000. One critical parameter is the hyperbolic radius, also known as $R_o$ which is functionally related to the selected mass. This is obvious from examination of the standard Mathieu equations which are used to describe a quadrupole mass filter. In such a filter with a change in temperature both the rods and the rod mountings will expand. Normally such expansion would cause a change in $R_o$ and a concomitant change in the mass to charge ratio that is filtered by the device.

Attempts have been made to maintain the temperature constant to obviate this difficulty. However, during practical use of a multipole mass filter it is frequently expedient to maintain the filter at a temperature above ambient. This reduces the chance of condensation of gas molecules on the surface of a rod, thus reducing contamination which would distort the field patterns. But under these conditions if the temperature of the ambient environment changes, temperature change will occur in the mass filter itself to cause a thermal expansion or contraction.

A typical method of construction was described in an article by M. S. Story (one of the coinventors of the present application) at the Fourteenth National Vacuum Symposium AVS 1967 using molybdenum rods on aluminum oxide mounts. This provided a structure capable of constant resolution between 25° and 400° C. However, such a structure did not have a constant $R_o$ over this temperature range.

Thus, in summary there is a need for a device where, when a given mass to charge ratio (M/e) is to be filtered, $R_o$ is maintained constant throughout the length of the filter; this requires mechanical precision. Moreover, in order to maintain the filter stability over length of time, $R_o$ should stay constant regardless of environmental changes.

OBJECTS AND SUMMARY OF THE INVENTION

It is, therefore, an object of the present invention to provide a temperature stable multipole mass filter and method therefor.

It is another object of the invention to provide a filter as above where the dimension radius of the inscribed circle $R_o$ remains invariant with changing temperature.

In accordance with the above objects there is provided a method of maintaining $R_o$ constant over a wide temperature range in a multiple mass filter having rods and a rod mounting means. The theoretical ratio of thermal coefficients of expansion of the rods and rod mounting means is determined to maintain $R_o$ constant with reference to a specific mass filter construction.

Rods and mounting means are respectively selected having thermal coefficients of expansion substantially matching the theoretical ratio. The rods are affixed to the mounting means.

In addition, filter apparatus is provided which meet the same criteria.

DETAILED DESCRIPTION OF THE PREFERRED EMBODIMENTS

Figure 1:
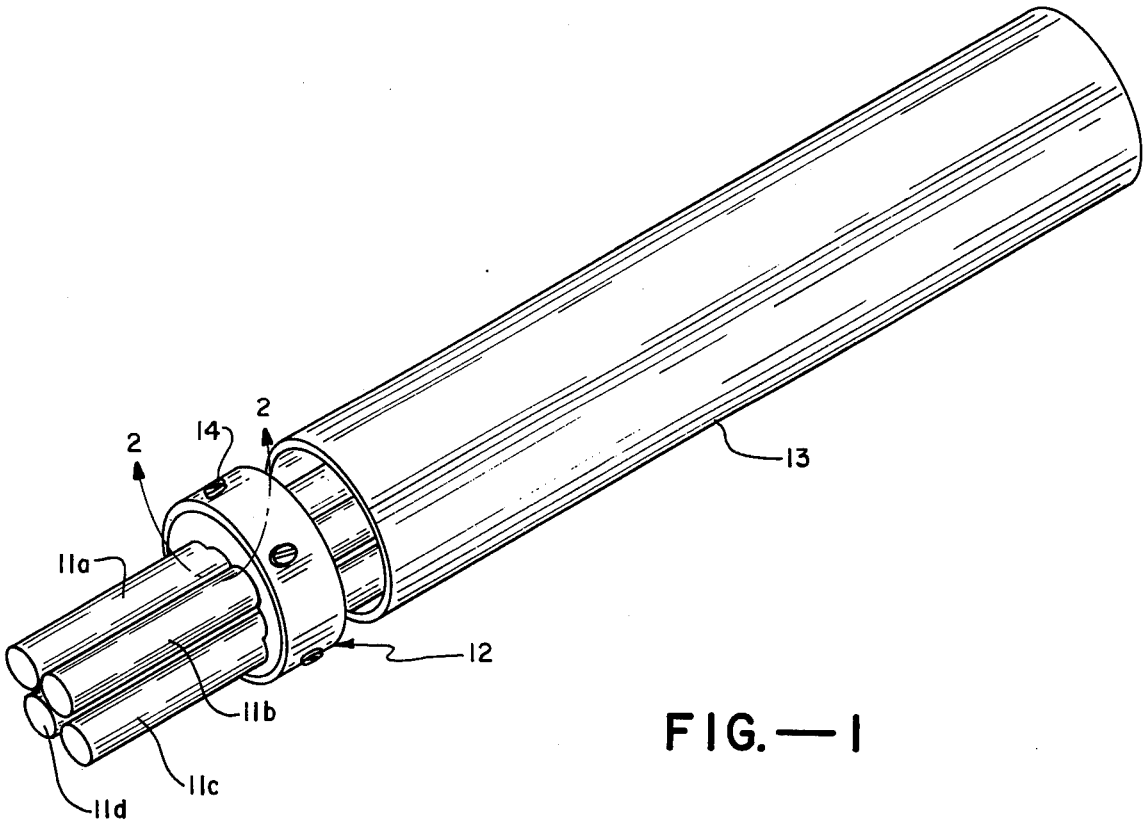
FIG. 1 is a perspective view of a mass filter embodying the present invention.
Figure 2:
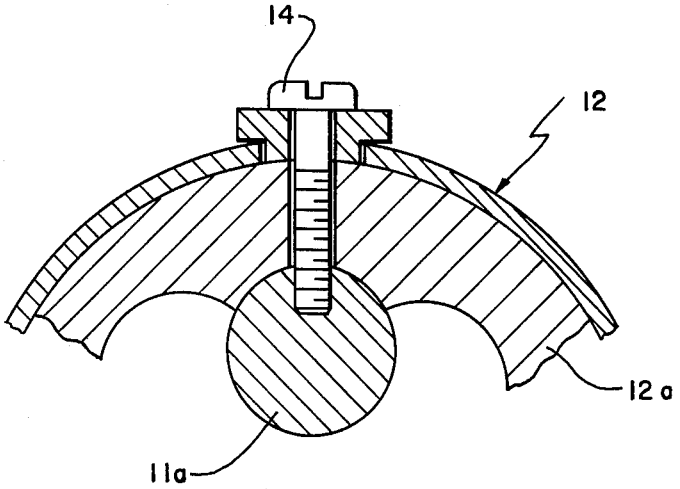
FIG. 2 is a partial cross-sectional view taken along the line 2—2 of FIG. 1.

FIG. 1 illustrates a mass filter of the quadrupole type having four cylindrical rods 11*a–d* which are mounted in the collar type mounting means 12. The overall shield 13 has been moved to the right as shown in the drawing to expose the remaining structure. FIG. 2 shows a detail of the mounting structure with a single rod 11*a* and includes a substantially annular mounting ring 12*a* of insulating material. Rod 11*a* is held against ring 12*a* by the screw 14.

Figure 3:
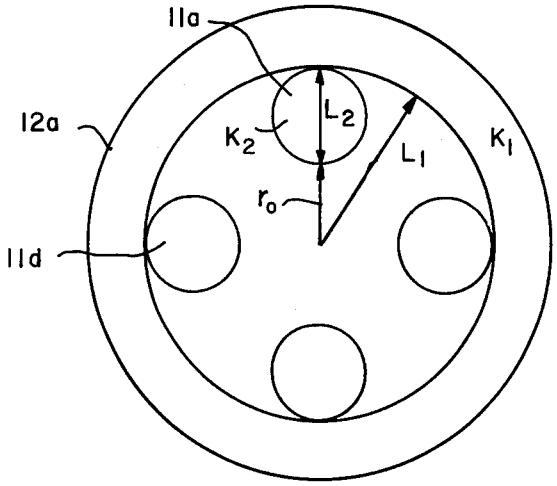
FIG. 3 is a completed diagrammatic view of FIG. 2.

FIG. 3 illustrates the completed structure of FIG. 2 in diagrammatic form where the mounting ring 12*a* is illustrated along with the various rods 11*a* through 11*d*. Ring 12*a* is illustrated as being of a material having a coefficient of expansion $K_1$ and the rods of a different material having a thermal coefficient of expansion $K_2$. The hyperbolic radius $R_o$ is indicated as being in the form of an inscribed circle from the center of the structure to tangency with the various rods. This is however a theoretical $R_o$; since in actuality the rods should be hyperbolic shape; the theoretical $R_o$ would not extend to the periphery of the cylindrical rods. However, in any case as discussed above in conjunction with the Mathieu equation, $R_o$ must be maintained constant in order that the mass to charge ratio will not change so that the mass passed by the filter is constant. In order to maintain such a relationship over a change of temperature, thermal coefficients of expansion must be chosen in manner to be discussed below.

Specifically, to maintain $\Delta R_o=0$ for a temperature change the following relationship is obvious;

$$L_1K_1 = L_2K_2 \tag{1}$$

where $K_1$ and $K_2$ are the respective coefficients of thermal expansion as defined above, $L_2$ is the diameter of a typical rod and $L_1$ the distance from the center of the quadrupole mass to the periphery of the mounting support 12*a*. By definition $$L_1 - L_2 = R_o \tag{2}$$

Since in practice cylindrical surfaces are used for convenience rather than hyperbolic surfaces D. R. Dennison has shown in an article in the *Journal of Vacuum Science Technology*, Volume 8, 1971, page 266, that the relationship between $R_o$ and the radius of the rods to provide an optimum approximation to a hyperbolic field should be that the radius of the rod is equal to 1.1468 $R_o$. Thus, the following relationship is apparent $$(L_2/2) = 1.468\ R_o. \quad (3)$$

Substituting equation (3) in equation (2) yields $$L_1 = R_o + 2(1.1468)R_o \quad (4)$$
$$L_1 = R_o\,(3.2936)$$

Rearranging equation (1) and substituting equations (3) and (4) yields $$\frac{K_2}{K_1} = \frac{L_1}{L_2} = \frac{R_o\,(3.2936)}{R_o\,(2.2936)} \quad (5)$$
$$= 1.436$$

Figure 4:
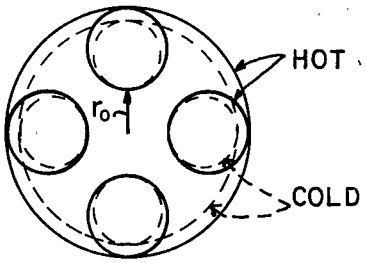
FIG. 4 is a view similar to FIG. 3 showing the structure at two different temperatures.

The foregoing illustrates that in a mass filter of the quadrupole type with cylindrical rods that the ratio of the coefficients of expansion is 1.436. With the choice of such a ratio, $R_o$ remains constant as illustrated in FIG. 4 where the dashed lines show the structure of FIG. 3 in a cold condition and the solid lines in a hot condition. Since the thermal coefficients of expansion compensate each other, $R_o$ remains constant and thus the mass to charge ratio passed by the filter remains constant in accordance with the objectives of the present invention.

Several mounting and rod materials will satisfy the above criteria. The rod material may be conductive or insulating with its surface having a conducting layer deposited on it. The mounting material must have insulating properties.

One suitable combination which performed adequately was the use of rods of molybdenum with a mount material of silicon nitride. In fact the use of silicon nitride and molybdenum was used to verify the above theory. Specific tests utilized the above set of materials and in addition also using alumina and molybdenum and alumina and stainless steel as the rod and mount materials, respectively. The temperature of the filter assembly was varied and the mass shift due to the change in $R_o$ measured. The alumina and molybdenum caused a shift in one direction and the alumina and stainless steel caused a shift in the other direction as predicted by theory. The silicon nitride and molybdenum filter caused a much reduced mass shift as predicted by the closer fit to equation (5). Specifically, the molybdenum has a temperature coefficient of $4.9\times\times10^{-6}K^{-1}$, the silicon nitride $2.7\times10^{-6k-1}$ to give a ratio of 1.815. Another suitable pair of materials would be Inconel 702 for the rods with a temperature coefficient of $12.0\times10^{-61-1}$ and Forsterite for the mounting structure with a temperature coefficient of $8.5\times10^{-6k-1}$ to give a ratio of 1.419 which is substantially equal to 1.436.

Figure 5:
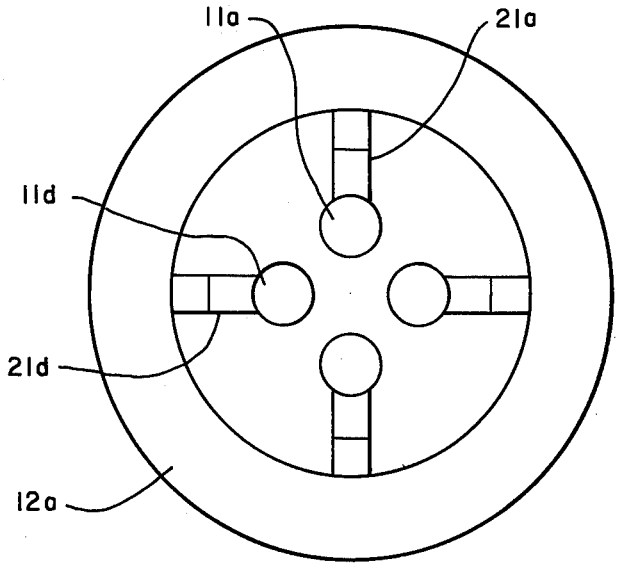
FIG. 5 is a diagrammatic cross-sectional view similar to FIG. 3 which illustrates an alternative embodiment.

FIG. 5 is an alternative embodiment where the mounting structure 12*a* also includes cantilevered supports 21*a* through *d*. These supports may be of one material or mixed materials. The materials would be chosen in accordance with the above criteria but, of course, the overall combined effective coefficient of expansion of the two or three materials of the mounting structure must meet the criteria of maintaining $R_o$ invariant.

Thus, in summary an improved method and construction for a temperature stable multipole mass filter and method therefor has been provided.

What is claimed is:

1. A method of maintaining $R_o$ constant over a wide temperature range in a multipole mass filter having rods and a rod mounting means comprising the following steps: determining the theoretical ratio of thermal coefficients of expansion of said rods and said rod mounting means to maintain $R_o$ constant with reference to a specific mass filter construction; selecting rods and rod mounting means respectively having thermal coefficient of expansion substantially matching said theoretical ratio; and affixing said rods to said mounting means.

2. A method as in claim 1 where said mass filter is of the quadrupole type with cylindrical rods and said ratio is substantially 1.436.

3. In a multipole mass filter having rods and mounting means said rods having a first coefficient of thermal expansion and said rod mounting means a second coefficient of thermal expansion said two coefficients being chosen so that the mass to charge ratio passed by said filter does not change with temperature.

4. A filter as in claim 3 where the parameter $R_o$ of said filter is maintained constant by said choice of coefficients.

5. A filter as in claim 3 which is of the quadrupole type with cylindrical rods and the ratio of said first to said second coefficients is substantially 1.436.

* * * * *

UNITED STATES PATENT AND TRADEMARK OFFICE

CERTIFICATE OF CORRECTION

PATENT NO. : 4,032,782

DATED : June 28, 1977

INVENTOR(S) : Ronald D. Smith et al

It is certified that error appears in the above-identified patent and that said Letters Patent are hereby corrected as shown below:

FIGURES 3 and 4, delete "$r_o$" and substitute therefor --$R_o$--

Column 3, Equation 3, should read $$(L_2/2) = 1.1468\ R_o.$$

Column 4, line 1, delete "$4.9XX10^{-6}K^{-1}$" and substitute therefor --$4.9 \times 10^{-6}K^{-1}$-- delete "$2.7x10^{-6k-1}$" and substitute therefor --$2.7 \times 10^{-6}K^{-1}$-- line 4, delete "$12.0x10^{-6l-1}$" and substitute therefor --$12.0 \times 10^{-6}K^{-1}$-- line 5, delete "$8.5x10^{-6k-1}$" and substitute therefor --$8.5 \times 10^{-6}K^{-1}$--

Signed and Sealed this

*Seventeenth* Day of *October 1978*

[SEAL]

*Attest:*

RUTH C. MASON
*Attesting Officer*

DONALD W. BANNER
*Commissioner of Patents and Trademarks*